US005957401A

United States Patent [19]

O'Donnell

[11] Patent Number: 5,957,401

[45] Date of Patent: Sep. 28, 1999

[54] DEVICE FOR STORING A STRING OF LIGHTS

[76] Inventor: Patricia Sessum O'Donnell, 100 Jeanne Ct., Stamford, Conn. 06903

[21] Appl. No.: 09/103,124

[22] Filed: Jun. 23, 1998

[51] Int. Cl.[6] ..... B65H 75/38

[52] U.S. Cl. ..... 242/404.3; 242/402; 242/405.1; 242/407; 242/613; 191/12.4

[58] Field of Search ..... 242/404.3, 407, 242/400.1, 402, 405.1, 613, 118.4; 191/12 R, 12.2 R, 12.4

[56] References Cited

U.S. PATENT DOCUMENTS

| | | | |
|---|---|---|---|
| D. 339,976 | 10/1993 | Ferguson, Sr. . | |
| D. 375,251 | 11/1996 | Stevens et al. . | |
| 1,938,565 | 11/1933 | Replogle . | |
| 3,290,453 | 12/1966 | Jensen | 242/400.1 X |
| 3,837,448 | 9/1974 | Hagstrom . | |
| 3,983,977 | 10/1976 | Crabb . | |
| 4,138,076 | 2/1979 | Oagley | 242/613 X |
| 4,143,746 | 3/1979 | Lowery . | |
| 4,520,239 | 5/1985 | Schwartz | 242/402 X |
| 4,778,125 | 10/1988 | Hu | 242/402 X |
| 4,917,323 | 4/1990 | Wing . | |
| 5,598,985 | 2/1997 | Winesett . | |
| 5,695,148 | 12/1997 | Christensen | 242/405.3 |

FOREIGN PATENT DOCUMENTS

| | | | |
|---|---|---|---|
| 80982 | 6/1963 | France | 242/613.1 |
| 223759 | 10/1924 | United Kingdom | 242/404.3 |

*Primary Examiner*—Donald P. Walsh
*Assistant Examiner*—William A. Rivera
*Attorney, Agent, or Firm*—Michael I. Kroll

[57] ABSTRACT

A hand reel storage device (10) for a holiday light string (12), having an elongate cord (14), a plurality of light sockets (16) with light bulbs (18), a plug (20) on a first end (22) and an outlet (24) on a second end (26). The hand reel storage device (10) comprises a spool (28) to hold the holiday light string (12) when the elongate cord (14) is wound thereabout. A facility (30) on a first end of the spool (28) is for retaining the first end (22) of the elongate cord (14) with the plug (20) of the holiday light string (12) in place. A facility (32) on a second end of the spool (28) is for retaining the second end (26) of the elongate cord (14) with the outlet (24) of the holiday light string (12) in place. When the holiday light string (12) is to be utilized the first end (22) of the elongate cord (14) with the plug (20) and the second end (26) of the elongate cord (14) with the outlet (24) can be disengaged to allow the elongate cord (14) of the holiday light string (12) to be unwound from the spool (28) by a person (34).

17 Claims, 5 Drawing Sheets

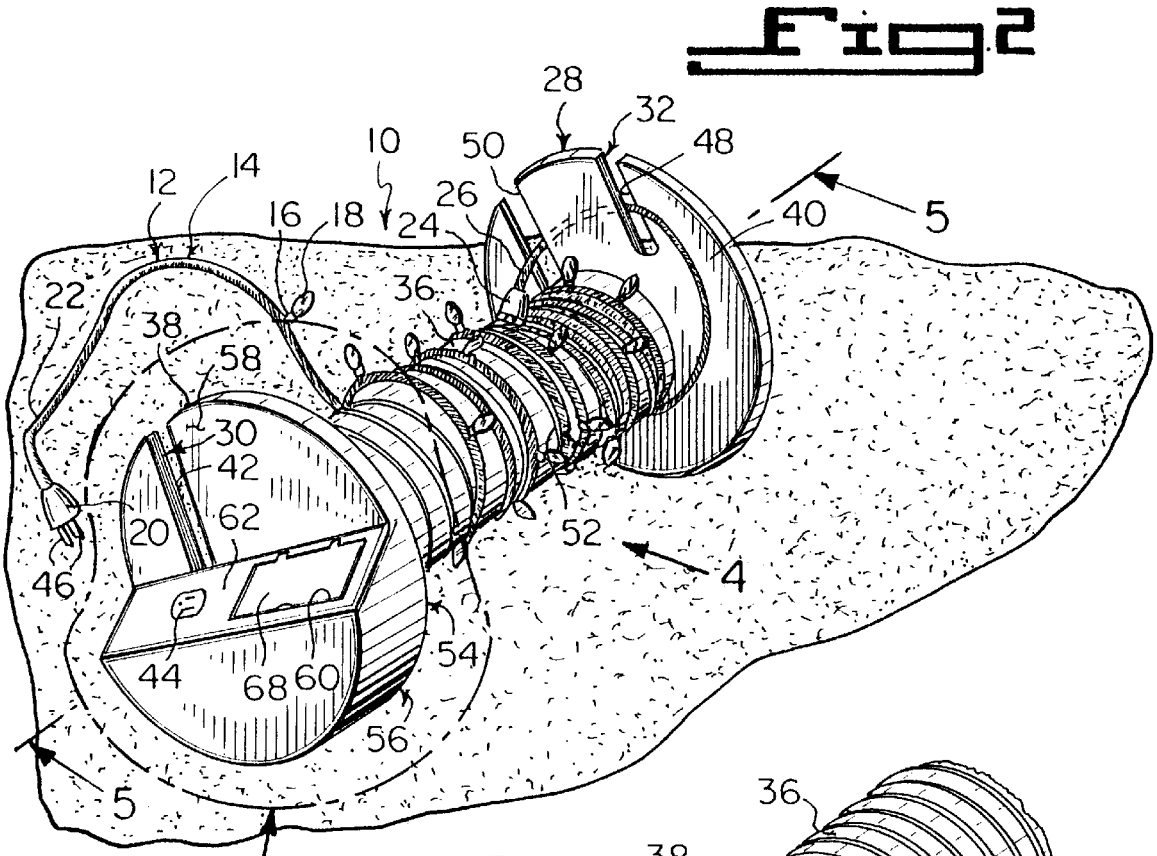
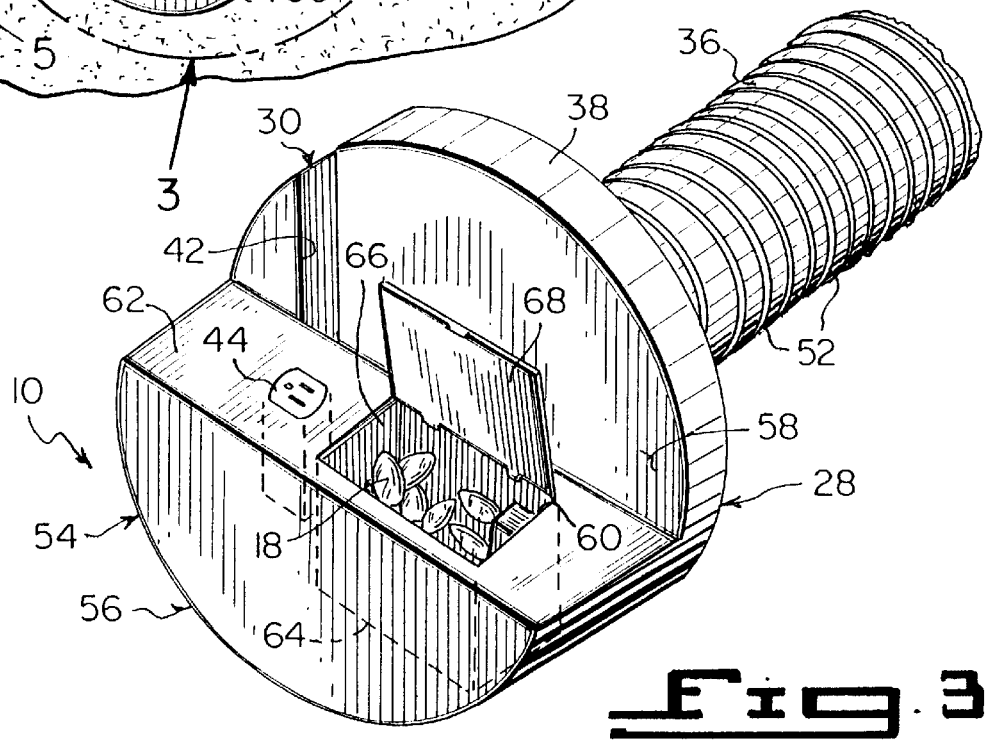
Fig. 3

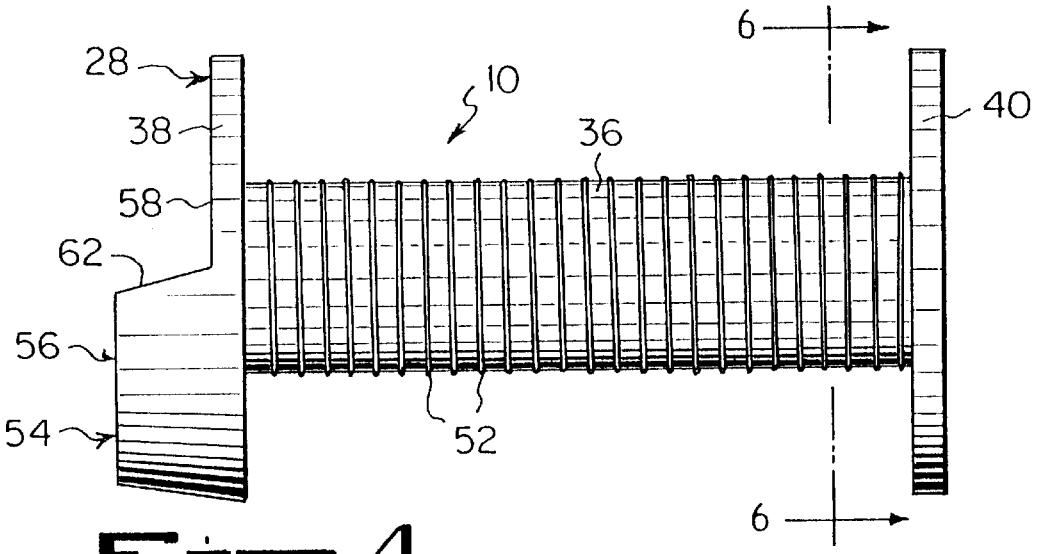
Fig. 4
Fig. 5
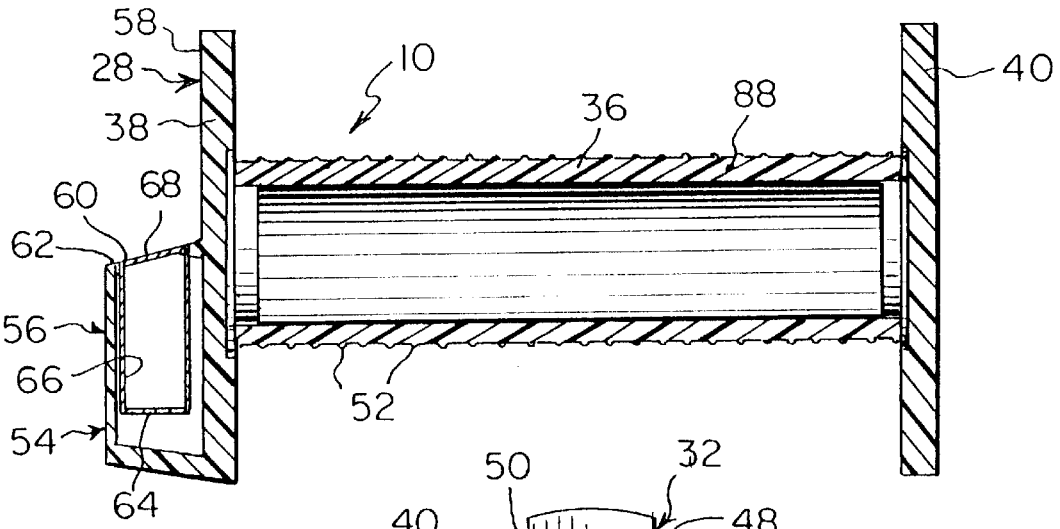
Fig. 6
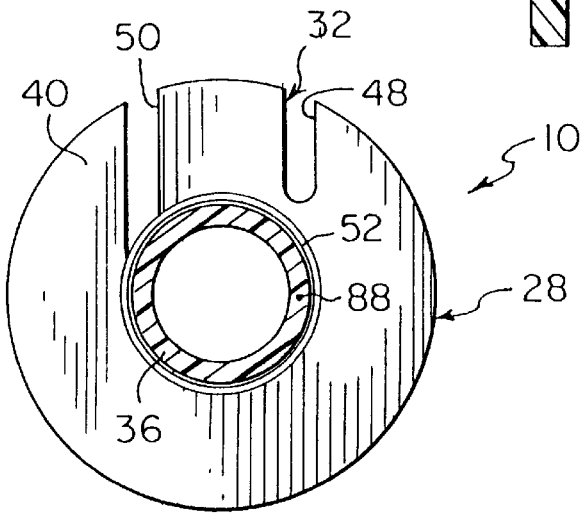

DEVICE FOR STORING A STRING OF LIGHTS

BACKGROUND OF THE INVENTION

1. Field of the Invention

The instant invention relates generally to reels for winding lines, more specifically to reels for winding lightweight, residential extension cords and particularly to a hand reel storage device for winding holiday light strings.

2. Description of the Prior Art

There exist hand reels for winding heavyweight electrical extension cords and other types of chains/lines. However, a lightweight, economical hand reel is particularly needed for winding holiday light strings. None of the hand reels known completely satisfy this need. Typically, a consumer will purchase holiday light strings in a flimsy, cardboard box which is discarded immediately after initial purchase. The holiday lights are then balled up, twisted, knotted and stored haphazardly along with other holiday decorations until subsequent use. Extra bulbs which are included in the holiday light string packages are typically discarded or lost since no storage for the extra bulbs currently exists. This practice causes consumers undue aggravation and unnecessarily wastes valuable time at the holiday season, especially when the consumer attempts to untangle the badly stored holiday light string or when the consumer makes a futile attempt to locate replacement bulbs for burned out bulbs on the string. Currently no hand reel/storage device is available which satisfies the above requirements.

Cord reels proposed are too heavy, bulky, complicated and expensive for the storage of holiday light strings. Some cord reels proposed have axles on which the spool turns. Although an important and convenient feature for winding and unwinding lines that are used frequently, a turning spool is unnecessary for a holiday light string that is typically wound and unwound only once per calendar year. Other reels proposed have a central bore for the user to support by the hand, have many more individual parts than desirable, or bulkier, heavier and sturdier than necessary for once-a-year use, while providing no storage for the extra bulbs.

Numerous reels for winding lines have been provided in prior art. For example, U.S. Pat. Nos. 1,983,565 to Replogle; 3,837,448 to Hagstrom; 3,983,977 to Crabb; 4,143,746 to Lowery; 4,917,323 to Wing; 5,598,985 to Winesett; Des. 339,976 to Ferguson, Sr. and Des. 375,251 to Stevens et al. all are illustrative of such prior art. While these units may be suitable for the particular purpose to which they address, they would not be as suitable for the purposes of the present invention as heretofore described.

REPLOGLE, DANIEL BENSON

CORD REEL AND METHOD OF MAKING THE SAME

U.S. Pat. No. 1,983,565

The herein described method of making a reel having a flanged spool and a casing, which comprises cutting the rear flange of the spool from a blank along a sinusoidal line. Assembling the parts of the spool and casing with the front casing member comprising the remaining portion of the blank, the scallops on the inner edge of the opening in the front casing member enclosing and overlapping the outer edge of the front flange of the spool.

HAGSTROM, LEONARD

LINE CORD CADDY

U.S. Pat. No. 3,837,448

An extension cord caddy comprising a spool having an extension cord wound thereon and being encased within a stand-up type cover having a hand grip extending relatively upwardly therefrom. The cover is made up of two saucer-shaped cover sections. One cover section in its central body portion having an inwardly projecting spindle serving as a spool mounting axle. The spindle by design has substantially shorter axial length than that of the spool bore, thereby contributing to the provision of a recess in the bore disposed beyond the spindle end-face for receiving a single or duplex receptacle member including a plurality of plug-in sockets which are accessible thru a circular receptacle face-plate affixed to the spool flange next adjacent the companion cover section. The companion cover section is provided in its body portion with a circular opening having a diameter substantially equalling that of the receptacle face-plate and appreciably less than that of the spool flange. The axial dimensions of the cover sections are such that when they are assembled one to the other with the spool in place on the spindle, they hold the spool to the spindle. Also, their inner-wall surfaces press on the outer surfaces of the spool side flanges, thereby engendering a drag force effective on the spool which prevents too fast turning thereof upon the extension cord being unspooled in use of the device.

CRABB, VIRGIL R.

ELECTRIC EXTENSION CORD REEL

U.S. Pat. No. 3,983,977

A reel for transporting a coiled electric cord a substantial distance from an electrical source of power to activate an electric appliance. The reel comprises a spool-like body having interior cone-shaped journals rotatably supported on matching cone-shaped bearings mounted on an axle. An elongate handle is rotatably mounted at one end of the spool for holding the reel and a shorter handle affixed to the other end of the spool, to rotate the same about the longitudinal axis of the axle. The transfer of electricity to an appliance is provided by means of an electrical receptacle secured to the spool. The reel incorporates adjustable means for regulating the rotation of the spool to compensate for varying tensile loads on the cord.

LOWERY, A. J.

HAND REEL

U.S. Pat. No. 4,143,746

A hand reel is disclosed herein particularly for use in winding electrical extension cords. The hand reel is a spool with flanges, with the cord adapted to be wrapped around the spool between the flanges. The spool has a central bore that is large enough to accommodate the user's hand. A supporting member is slidingly attached to the spool inside the bore, allowing the spool to be rotated while holding the supporting member. The arcuate length of the supporting member is much less than the diameter of the bore, minimizing friction and allowing cleaning.

WING, DON

CHRISTMAS LIGHT STORE DEVICE

U.S. Pat. No. 4,917,323

A Christmas tree light storage device consisting of one or more discs each with a plurality of radially oriented slots around the outside circumference thereof. The disc or discs are concentrically mounted on a central cylinder. Light sockets are mounted sequentially over the slots with the cable to and from the sockets passing through the slots and being wrapped around the central cylinder.

WINESETT, SANDY C.

CHRISTMAS LIGHT REEL

U.S. Pat. No. 5,598,985

A Christmas light reel includes a spool housing, a spool disposed within the housing, a crank having a shaft passing through the spool and the housing in a manner such that the spool and the shaft rotate together with respect to the housing. The spool includes a resilient spool cylinder and a pair of cord clips. One cord clip is located at each end of the spool for securing the ends of a string of lights wound upon the spool. The resilient spool is preferably constructed from a plastic foam material and coated with a tacky adhesive.

FERGUSON, SR., RICHARD P.

COMBINED CHRISTMAS TREE LIGHT STORAGE REEL AND COVER THEREFOR

U.S. Pat. No. Des. 339,976

The ornamental design for a combined Christmas tree light storage reel and cover therefor, as shown and described.

FIG. 2 is a front elevational view thereof.

FIG. 3 is a rear elevational view thereof.

FIG. 4 is a side elevational view thereof.

FIG. 5 is an opposite side elevational view thereof.

FIG. 6 is a top plan view thereof.

FIG. 7 is a bottom view thereof.

STEVENS, ROGER L.

STEVENS, PAULA

CHRISTMAS LIGHTS STORAGE CADDY

U.S. Pat. No. Des. 375,251

The ornamental design for a Christmas light storage caddy, as shown and described.

Figure 1:
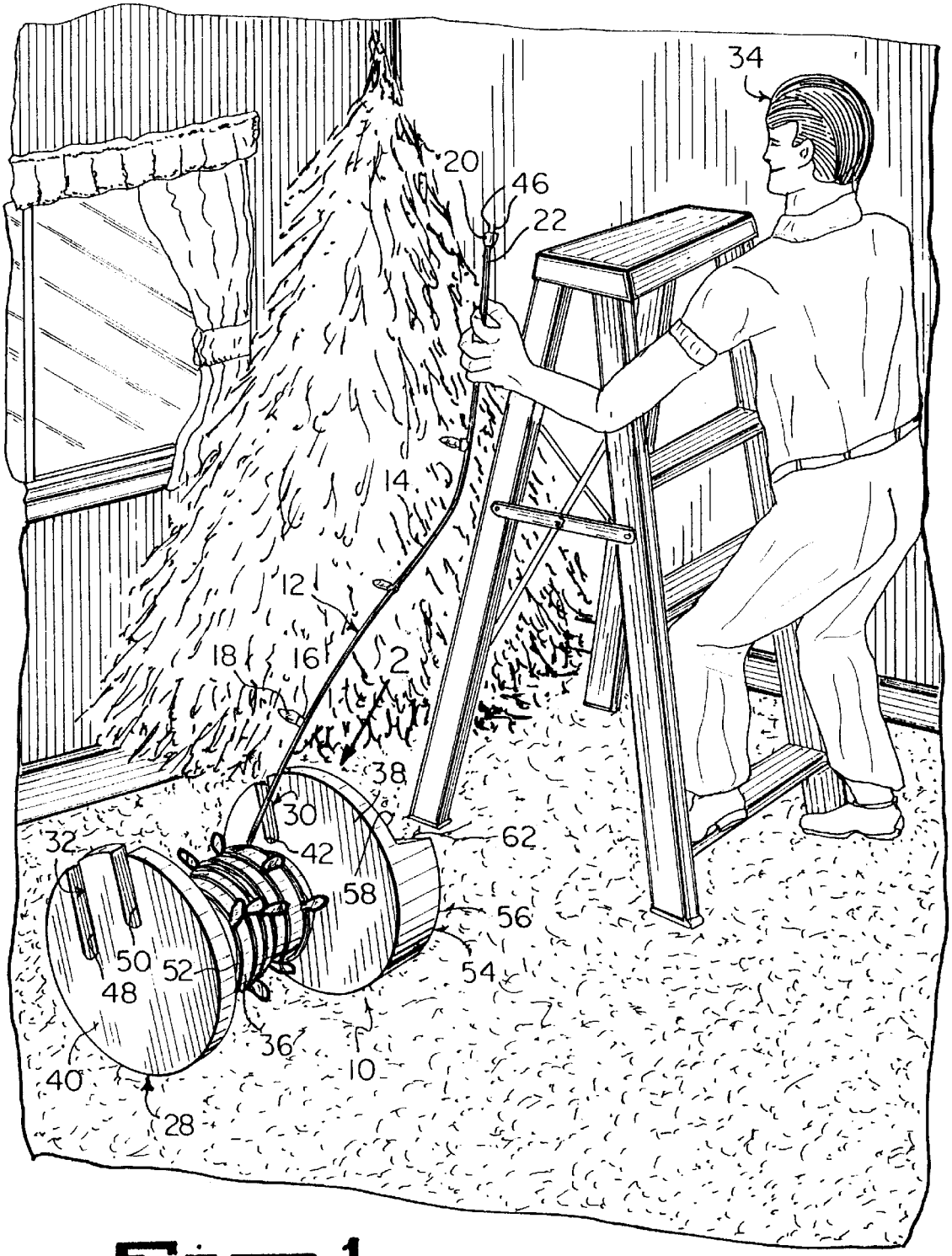
FIG. 1 is a perspective view of the combined Christmas tree light storage reel and cover therefor embodying the design of the present invention.

FIG. 1 is an environmental perspective view of a Christmas light storage caddy, showing the new design.

FIG. 2 is a front elevational view thereof.

FIG. 3 is a rear elevational view thereof.

FIG. 4 is a right side elevational view thereof.

FIG. 5 is a left side elevational thereof.

FIG. 6 is a top view thereof.

FIG. 7 is a bottom view thereof.

The broken line showing the decorative cover and storage bin and the fragmented strand of Christmas lights is for illustrative purposes only and forms no part of the claimed design.

SUMMARY OF THE INVENTION

The hand reel storage device enables users of holiday light strings to easily and conveniently store a holiday light string along with extra bulbs until subsequent use, typically once per year. The hand reel has a spool around which a holiday light string is wound, one flange with a slot through which an end of the string is threaded, an electrical receptacle for the "male plug" end of the string, a storage compartment for extra bulbs and a second flange with two slots through which to thread the "female plug" end of the string, so that it rests safely within the confines of the reel.

A primary object of the present invention is to provide a hand reel storage device that will overcome the shortcomings of the prior art devices.

Another object is to provide a hand reel storage device that is extremely lightweight and not complex in construction, making it a practical item to purchase for the typical consumer of holiday light strings.

An additional object is to provide a hand reel storage device that can accommodate a string of holiday lights and extra bulbs.

A further object is to provide a hand reel storage device that is simple and easy to use.

A still further object is to provide a hand reel storage device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the present invention in use indoors, showing a person unwinding a holiday light string therefrom.

Figure 1A:
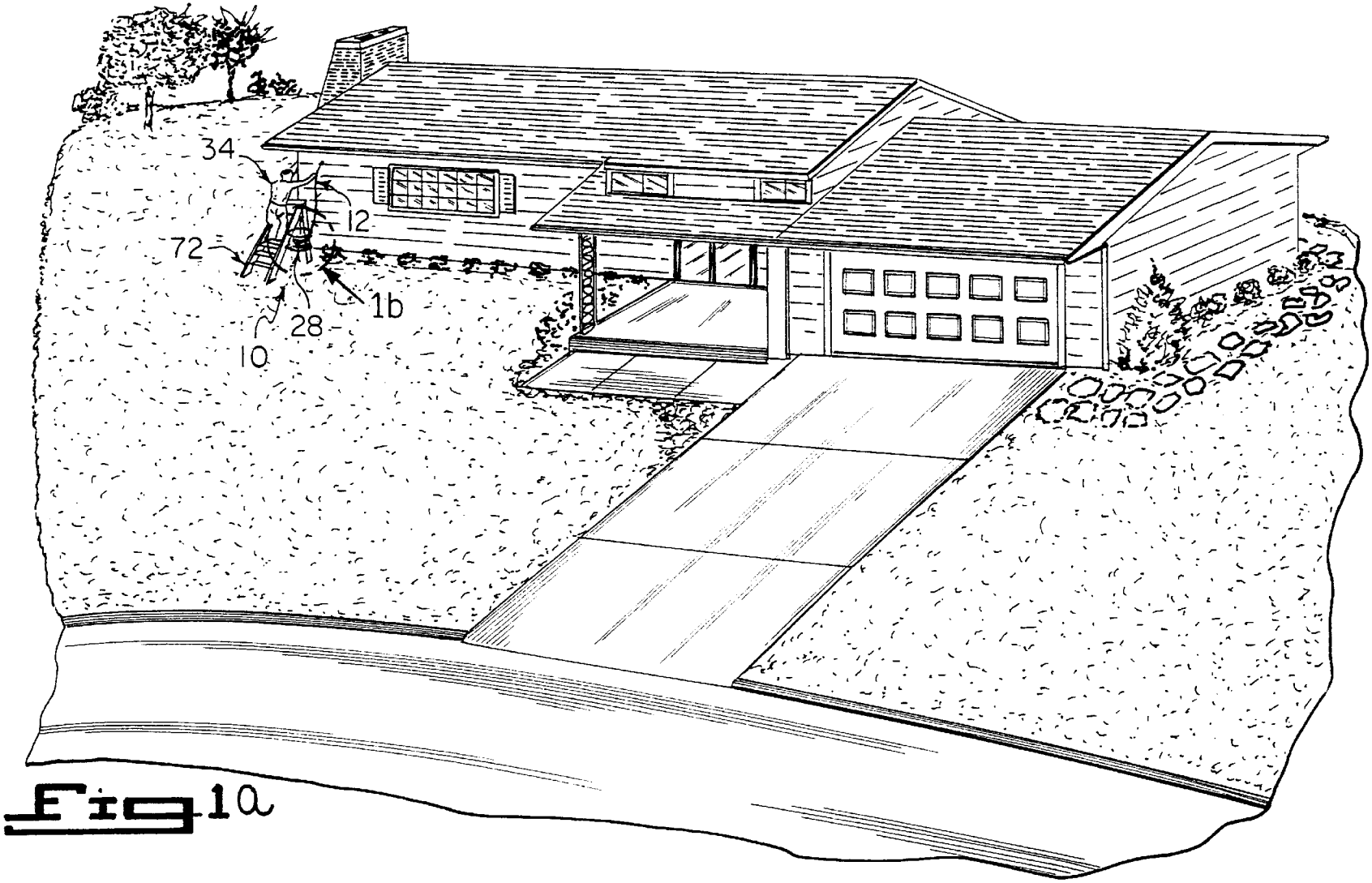

FIG. 1*a* is a perspective view of the present invention in use outdoors, showing a person unwinding a holiday light string therefrom.

Figure 1B:
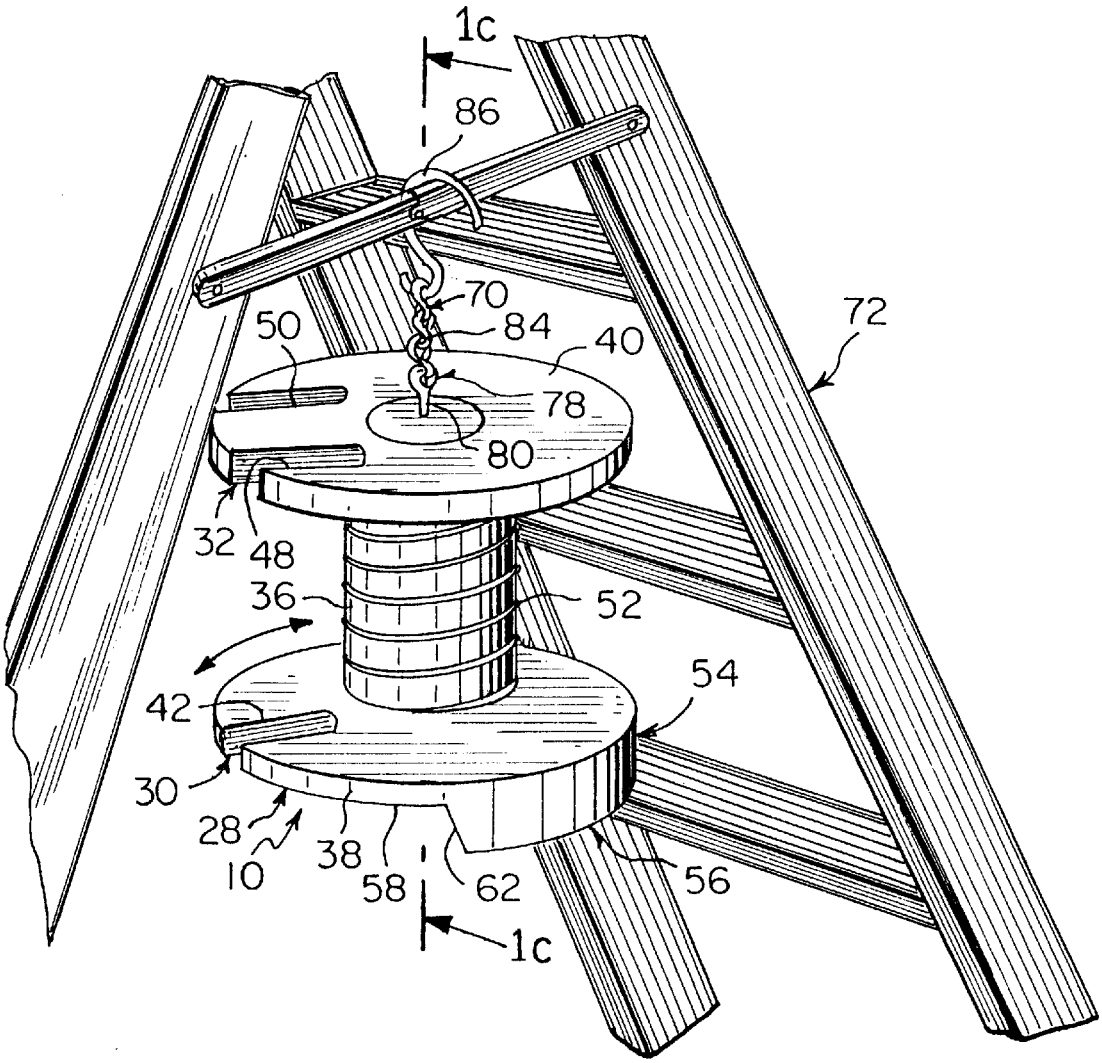

FIG. 1*b* is an enlarged perspective view of the area indicated by arrow 1*b* in FIG. 1*a*, showing the spool hooked onto and vertically suspended from a ladder.

Figure 1C:
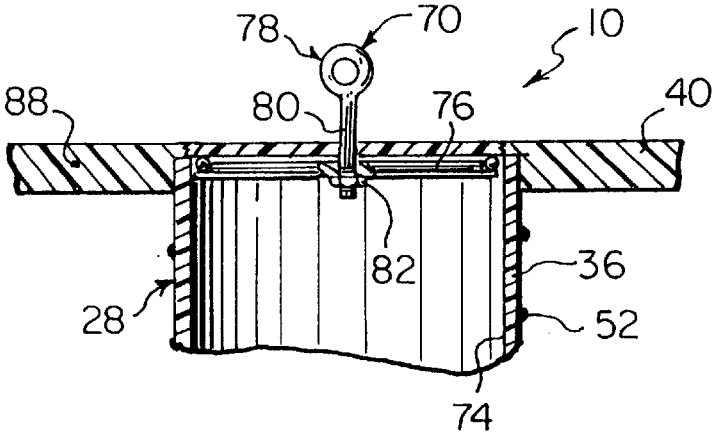

FIG. 1*c* is a cross sectional view of a portion of the present invention taken along line 1*c*—1*c* in FIG. 1*b*.

FIG. 2 is a perspective view of the present invention taken in the direction of arrow 2 in FIG. 1.

FIG. 3 is an enlarged perspective view of an area in FIG. 2 as indicated by arrow 3, showing a snap-on lid opened and the extra bulbs within the storage compartment of the receptacle.

FIG. 4 is a side view taken in the direction of arrow 4 in FIG. 2.

FIG. 5 is a horizontal cross sectional view taken along line 5—5 in FIG. 2.

FIG. 6 is a vertical cross sectional view taken along line 6—6 in FIG. 4.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 6 illustrate the present invention being a hand reel storage device 10. With regard to the reference numerals used, the following numbering is used throughout the various drawing figures.

| | |
|---|---|
| 10 | hand reel storage device |
| 12 | holiday light string |
| 14 | elongate cord of 12 |
| 16 | light socket of 12 on 14 |
| 18 | light bulb of 12 in 16 |
| 20 | plug of 12 on 22 |
| 22 | first end of 14 |
| 24 | outlet of 12 on 26 |
| 26 | second end of 14 |
| 28 | spool of 10 |
| 30 | first retaining facility of 10 |
| 32 | second retaining facility of 10 |
| 34 | person |
| 36 | elongate cylindrical hub of 28 |
| 38 | first circular flange of 28 |
| 40 | second circular flange of 28 |
| 42 | slot of 30 in 38 |
| 44 | dummy electrical outlet of 30 |
| 46 | prong of 20 |
| 48 | first slot of 32 in 40 |
| 50 | second slot of 32 in 40 |
| 52 | annular rib divider on 36 |
| 54 | storing structure of 10 |
| 56 | hollow housing of 54 |
| 58 | exterior surface of 38 |
| 60 | opening in 62 |
| 62 | top wall of 54 |
| 64 | receptacle of 54 in 56 |
| 66 | storage compartment in 64 |
| 68 | snap on lid of 54 for 60 |
| 70 | suspending assembly of 10 |
| 72 | stationary object |
| 74 | central bore in 36 |
| 76 | disc shaped ball bearing plate of 70 in 74 |
| 78 | eyelet bolt of 70 |
| 80 | threaded shaft of 78 |
| 82 | nut of 70 on 80 |
| 84 | chain of 70 |
| 86 | S-hook of 70 |
| 88 | lightweight durable material for 28 |

The hand reel store device 10 is for a holiday light string 12, having an elongate cord 14, a plurality of light sockets 16 with light bulbs 18, a plug 20 on a first end 22 and an outlet 24 on a second end 26. The hand reel storage device 10 comprises a spool 28 to hold the holiday light string 12 when the elongate cord 14 is wound thereabout. A facility 30 on a first end of the spool 28 is for retaining the first end 22 of the elongate cord 14 with the plug 20 of the holiday light string 12 in place. A facility 32 on a second end of the spool 28 is for retaining the second end 26 of the elongate cord 14 with the outlet 24 of the holiday light string 12 in place. When the holiday light string 12 is to be utilized the first end 22 of the elongate cord 14 with the plug 20 and the second end 26 of the elongate cord 14 with the outlet 24 can be disengaged to allow the elongate cord 14 of the holiday light string 12 to be unwound from the spool 28 by a person 34.

The spool 28 includes an elongate cylindrical hub 36. A first circular flange 38 is secured to a first end of the elongate cylindrical hub 36. A second circular flange 40 is secured to a second end of the elongate cylindrical hub 36. The first circular flange 38 and the second circular flange 40 have a diameter greater than the diameter of the elongate cylindrical hub 36.

The first retaining facility 30 consists of the first circular flange 38 having a slot 42 extending downwardly from the circumference towards the elongate cylindrical hub 36, so that the first end 22 of the elongate cord 14 of the holiday light string 12 with the plug 20 can be looped through the slot 42. The first retaining facility 30 further contains a dummy electrical outlet 44, to engage with the prongs 46 of the plug 20 on the first end 22 of the elongate cord 14 of the holiday light string 12, so as to maintain the plug 20 thereto.

The second retaining facility 32 includes the second circular flange 40 having two spaced apart parallel slots 48, 50 extending down from the circumference towards the elongate cylindrical hub 36, so that the second end 26 of the elongate cord 14 of the holiday light string 12 with the outlet 24 can be looped through the two slots 48, 50. The spool 28 can include a plurality of spaced apart annular rib dividers 52 formed about the elongate cylindrical hub 36, so as to prevent tangling of the elongate cord 14 of the holiday light string 12, when wound about the elongate cylindrical hub 36. The hand reel storage device 10 further contains a structure 54 in the first circular flange 38, for storing extra light bulbs 18 for future use.

The storing structure 54 comprises a hollow housing 56 being semi-cylindrical, integral with and extending outwardly from one half of an exterior surface 58 of the first circular flange 38. The hollow housing 56 has an opening 60 in a top wall 62 thereof. A receptacle 64 is within the hollow housing 56 under the opening 60 in the top wall 62. The receptacle 64 has a storage compartment 66 therein to receive the extra light bulbs 18. A snap on lid 68 covers the opening 60 in the top wall 62 of the hollow housing 56, so as to keep the extra light bulbs 18 within the storage compartment 66 of the receptacle 64 until needed.

The hand reel storage device 10, as best seen in FIGS. 1*a* and 1*b*, can further contain an assembly 70 for suspending the spool 28 vertically from a stationary object 72, such as a ladder, to allow the spool 28 to rotate thereabout, so that the elongate cord 14 of the holiday light string 12 can freely unwind from the spool 28.

The suspending assembly 70 includes the elongate cylindrical hub 36, having a central bore 74 extending longitudinally therethrough. A disc shaped ball bearing plate 76 is rotatively mounted within the central bore 74 at the second end of the elongate cylindrical hub 36. An eyelet bolt 78 having a threaded shaft 80 extends centrally through the second circular flange 40 and the disc shaped ball bearing plate 74. A nut 82 is on the threaded shaft 80 of the eyelet bolt 78, to retain the eyelet bolt 78 to the disc shaped ball bearing plate 76. A chain 84 is connected at a first end to the eyelet bolt 78. An S-hook 86 is connected to a second end of the chain 84, so that the S-hook 86 can engage with the stationary object 72, to allow the spool 28 to be vertically suspended and rotate thereabout.

The spool 28 is fabricated out of a lightweight durable material 88. The lightweight durable material 88 can be selected from a group consisting of plastic, metal, wood, styrofoam and cardboard.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent as set forth in the appended claims:

1. A hand reel storage device for a holiday light string, having an elongate cord, a plurality of light sockets with light bulbs, a plug on a first end and an outlet on a second end, wherein said hand reel storage device comprises:

a) a spool to hold the holiday light string when the elongate cord is wound thereabout, said spool including an elongate cylindrical hub; a first circular flange secured to a first end of said elongate cylindrical hub; and a second circular flange secured to a second end of said elongate cylindrical hub, whereby said first circular flange and said second circular flange having a diameter greater than the diameter of said elongate cylindrical hub;

b) means on first end of said spool for retaining the first end of the elongate cord with the plug of the holiday light string in place;

c) means on a second end of said spool for retaining the second end of the elongate cord with the outlet of the holiday light sting in place, so that when the holiday light string is to be utilized the first end of the elongate light cord with the plug and the second end of the elongate cord with the outlet can be disengaged to allow the elongate cord of the holiday light string to be unwound from said spool by a person, and d) means in said first circular flange for storing extra light bulbs for future use.

2. A hand reel storage device as recited in claim 1, wherein said first retaining means includes said first circular flange having a slot extending downwardly from the circumference towards said elongate cylindrical hub, so that the first end of the elongate cord of the holiday light string with the plug can be looped through said slot.

3. A hand reel storage device as recited in claim 2, wherein said first retaining means further includes a dummy electrical outlet to engage with the prongs of the plug on the first end of the elongate cord of the holiday light string, so as to maintain the plug thereto.

4. A hand reel storage device as recited in claim 3, wherein said second retaining means includes said second circular flange having two spaced apart parallel slots extending down from the circumference towards said elongate cylindrical hub, so that the second end of the elongate cord of the holiday light string with the outlet can be looped through said two slots.

5. A hand reel storage device as recited in claim 4, wherein said spool further in includes a plurality of spaced apart annular rib dividers formed about said elongate cylindrical hub, so as to prevent tangling of the elongate cord of the holiday light string when wound about said elongate cylindrical hub.

6. A hand reel storage device as recited in claim 5, wherein said storing means includes:

a) a hollow housing being semi-cylindrical, integral with and extending outwardly from one half of an exterior surface of said first circular flange, whereby said hollow housing having an opening in a top wall thereof;

b) a receptacle within said hollow housing under the opening in the top wall, whereby said receptacle having a storage compartment therein to receive the extra light bulbs; and c) a snap on lid to cover the opening in the top wall of said hollow housing, so as to keep the extra light bulbs within the storage compartment of said receptacle until needed.

7. A hand reel storage device as recited in claim 6, further including means for suspending said spool vertically from a stationary object, to allow said spool to rotate thereabout, so that the elongate cord of the holiday light string can freely unwind from said spool.

8. A hand reel storage device as recited in claim 7, wherein said suspending means includes:

a) said elongate cylindrical hub having a central bore extending longitudinally therethrough;

b) a disc shaped ball bearing plate rotatively mounted within said central bore at the second end of said elongate cylindrical hub;

c) an eyelet bolt having a threaded shaft extending centrally through said second circular flange and said disc shaped ball bearing plate;

d) a nut on said threaded shaft of said eyelet bolt to retain said eyelet bolt to said disc shaped ball bearing plate;

e) a chain connected at a first end to said eyelet bolt; and f) an S-hook connected to a second end of said chain, so that said S-hook can engage with the stationary object, to allow said spool to be vertically suspended and rotate thereabout.

9. A hand reel storage device as recited in claim 8, wherein said spool is fabricated out of a lightweight durable material.

10. A hand reel storage device as recited in claim 9, wherein said lightweight durable material can be selected from a group consisting of plastic, metal, wood, styrofoam and cardboard.

11. A hand reel storage device as recited in claim 1, wherein said second retaining means includes said second circular flange having two spaced apart parallel slots extending down from the circumference towards said elongate cylindrical hub, so that the second end of the elongate cord of the holiday light string with the outlet can be looped through said two slots.

12. A hand reel storage device as recited in claim 1, wherein said spool further includes a plurality of spaced apart annular rib dividers formed about said elongate cylindrical hub, so as to prevent tangling of the elongate cord of the holiday light string when wound about said elongate cylindrical hub.

13. A hand reel storage device as recited in claim 1, wherein said storing means includes:

a) a hollow housing being semi-cylindrical, integral with and extending outwardly from one half of an exterior surface of said first circular flange, whereby said hollow housing having an opening in a top wall thereof;

b) a receptacle within said hollow housing under the opening in the top wall, whereby said receptacle having a storage compartment therein to receive the extra light bulbs; and c) a snap on lid to cover the opening in the top wall of said hollow housing, so as to keep the extra light bulbs within the storage compartment of said receptacle until needed.

14. A hand reel storage device as recited in claim 1, further including means for suspending said spool vertically from a stationary object, to allow said spool to rotate thereabout, so that the elongate cord of the holiday light string can freely unwind from said spool.

15. A hand reel storage device as recited in claim 14, wherein said suspending means includes:

a) said elongate cylindrical hub having a central bore extending longitudinally therethrough;

b) a disc shaped ball bearing plate rotatively mounted within said central bore at the second end of said elongate cylindrical hub;

c) an eyelet bolt having a threaded shaft extending centrally through said second circular flange and said disc shaped ball bearing plate;

d) a nut on said threaded shaft of said eyelet bolt to retain said eyelet bolt to said disc shaped ball bearing plate;

e) a chain connected at a first end to said eyelet bolt; and f) an S-hook connected to a second end of said chain, so that said S-hook can engage with the stationary object, to allow said spool to be vertically suspended and rotate thereabout.

16. A hand reel storage device as recited in claim 1, wherein said spool is fabricated out of a lightweight durable material.

17. A hand reel storage device as recited in claim 16, wherein said lightweight durable material can be selected from a group consisting of plastic, metal, wood, styrofoam and cardboard.

* * * * *